US008903271B2

(12) United States Patent
Fujii

(10) Patent No.: US 8,903,271 B2
(45) Date of Patent: Dec. 2, 2014

(54) IMAGE FORMING APPARATUS PROVIDED WITH A PHOTOSENSITVE DRUM AND A STATIC ELIMINATOR IN A FIXED POSITION IN THE APPARATUS FACING THE PHOTOSENSITIVE DRUM

(71) Applicant: KYOCERA Document Solutions Inc., Osaka (JP)

(72) Inventor: Hirokazu Fujii, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 17 days.

(21) Appl. No.: 13/893,720

(22) Filed: May 14, 2013

(65) Prior Publication Data

US 2013/0308977 A1 Nov. 21, 2013

(30) Foreign Application Priority Data

May 17, 2012 (JP) ..... 2012-113388

(51) Int. Cl.
*G03G 15/00* (2006.01)
*G03G 21/08* (2006.01)
*G03G 21/16* (2006.01)

(52) U.S. Cl.
CPC ..... *G03G 21/08* (2013.01); *G03G 21/1671* (2013.01)
USPC ..... 399/111

(58) Field of Classification Search
USPC ..... 399/111
See application file for complete search history.

(56) References Cited

U.S. PATENT DOCUMENTS

2011/0299873 A1* 12/2011 Ushiozu et al. ..... 399/90

FOREIGN PATENT DOCUMENTS

JP 2007322912 A * 12/2007
JP 2011-70105 4/2011
JP 2013228635 A * 11/2013

* cited by examiner

*Primary Examiner* — Quana M Grainger
(74) *Attorney, Agent, or Firm* — Gerald E. Hespos; Michael J. Porco; Matthew T. Hespos

(57) ABSTRACT

An image forming apparatus includes a housing with an inner space, a photosensitive drum, a drum unit, a rail member, and a static eliminator. The photosensitive drum includes a rotating shaft, and a circumferential surface to be drivingly rotated around the rotating shaft for carrying an image thereon. The drum unit is inserted in the inner space of the housing along an axis direction of the rotating shaft in a state that the photosensitive drum is integrally supported to be mounted in the inner space. The rail member extends along the axis direction in the inner space for guiding the drum unit in the axis direction when the drum unit is mounted. The static eliminator is fixed to the rail member, and disposed to face the photosensitive drum in the drum unit mounted in the inner space for irradiating the circumferential surface of the photosensitive drum with static eliminating light.

8 Claims, 8 Drawing Sheets

IMAGE FORMING APPARATUS PROVIDED WITH A PHOTOSENSITVE DRUM AND A STATIC ELIMINATOR IN A FIXED POSITION IN THE APPARATUS FACING THE PHOTOSENSITIVE DRUM

This application relates to and claims priority from Japanese Patent Application No. 2012-113388, filed in the Japan Patent Office on May 17, 2012, the entire disclosure of which is incorporated herein by reference.

BACKGROUND

The present disclosure relates to an image forming apparatus for forming an image on a sheet, and more particularly, to an image forming apparatus provided with a static eliminator for irradiating a photosensitive drum with static eliminating light.

Conventionally, in an image forming apparatus for forming an image on a sheet, a toner image is formed on a circumferential surface of a photosensitive drum, and the toner image is transferred onto a sheet in a transfer portion. The image forming apparatus is further provided with a fixing portion. A sheet carrying a transferred toner image is subjected to a fixing process in a fixing portion, and then discharged to the outside of the apparatus.

A cleaning member removes toner that remains on the circumferential surface of the photosensitive drum after the transfer operation. Additionally, a static eliminator is disposed to face the photosensitive drum and removes the electric charges remaining on the circumferential surface of the photosensitive drum after the cleaning operation. The static eliminator irradiates the circumferential surface of the photosensitive drum with static eliminating light to remove the remaining electric charges.

A photosensitive drum is required to be dismounted from the image forming apparatus main body for replacement. In view of the above, the photosensitive drum is integrally supported on a drum unit, and is dismountably mounted to the image forming apparatus main body. Generally, the life of a static eliminator is long, as compared with the life of a photosensitive drum. In the case where such a static eliminator is integrally disposed with a drum unit, and is replaced together with a photosensitive drum, the cost of the drum unit may unnecessarily increase. There is known, as a conventional device, a device constructed such that a static eliminator is fixedly mounted to an exhaust duct in an apparatus main body.

In the aforementioned conventional device, the static eliminator extends toward the photosensitive drum from the exhaust duct disposed away from the photosensitive drum. Accordingly, in the above configuration, the position precision of the static eliminator relative to the circumferential surface of the photosensitive drum is unstable. As a result, the light amount of static eliminating light to be irradiated onto the circumferential surface of the photosensitive drum may vary. In addition, the conventional device is provided with a moving mechanism for moving the static eliminator toward the photosensitive drum. In the above configuration, the cost of the entire apparatus may resultantly increase.

An object of the present disclosure is to provide an image forming apparatus that enables to reduce the cost of a drum unit for supporting a photosensitive drum, and to enhance the position precision of a static eliminator relative to the photosensitive drum.

SUMMARY

An image forming apparatus according to an aspect of the present disclosure is provided with a housing with an inner space, a photosensitive drum, a drum unit, a rail member, and a static eliminator. The photosensitive drum includes a rotating shaft, and a circumferential surface to be driven and rotated around the axis of the rotating shaft for carrying an image on the circumferential surface. The drum unit that is inserted in the inner space of the housing along the axis direction of the rotating shaft in a state that the photosensitive drum is integrally supported to be mounted in the inner space. The rail member extends along the axis direction in the inner space for guiding the drum unit along the axis direction when the drum unit is mounted. The static eliminator is fixedly mounted to the rail member, and is disposed to face the photosensitive drum in the drum unit mounted in the inner space for irradiating the circumferential surface of the photosensitive drum with static eliminating light.

These and other objects, features and advantages of the present disclosure will become more apparent upon reading the following detailed description along with the accompanying drawings.

DETAILED DESCRIPTION

Figure 1:
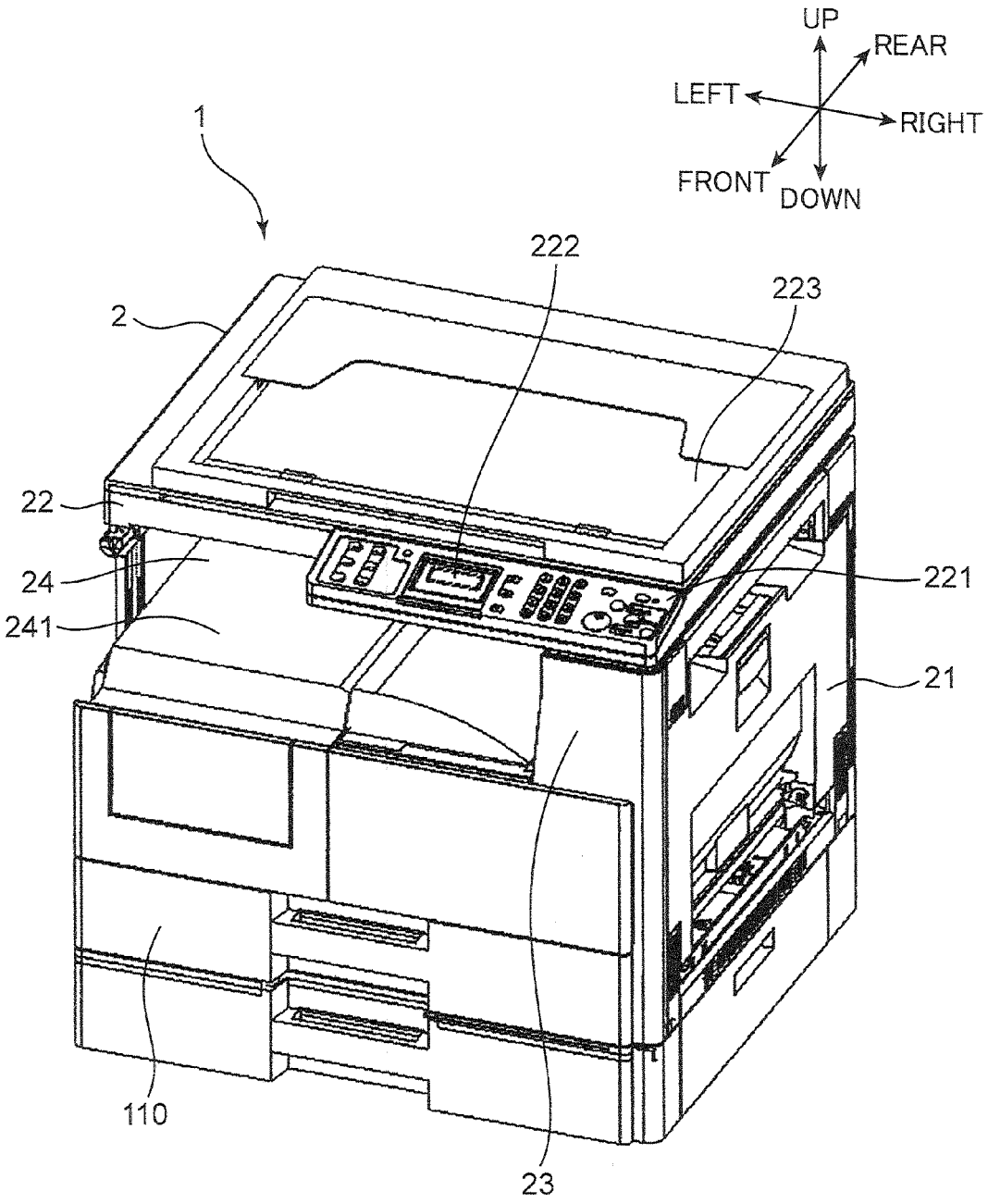
FIG. 1 is a perspective view of an image forming apparatus according to an embodiment of the present disclosure.
Figure 2:
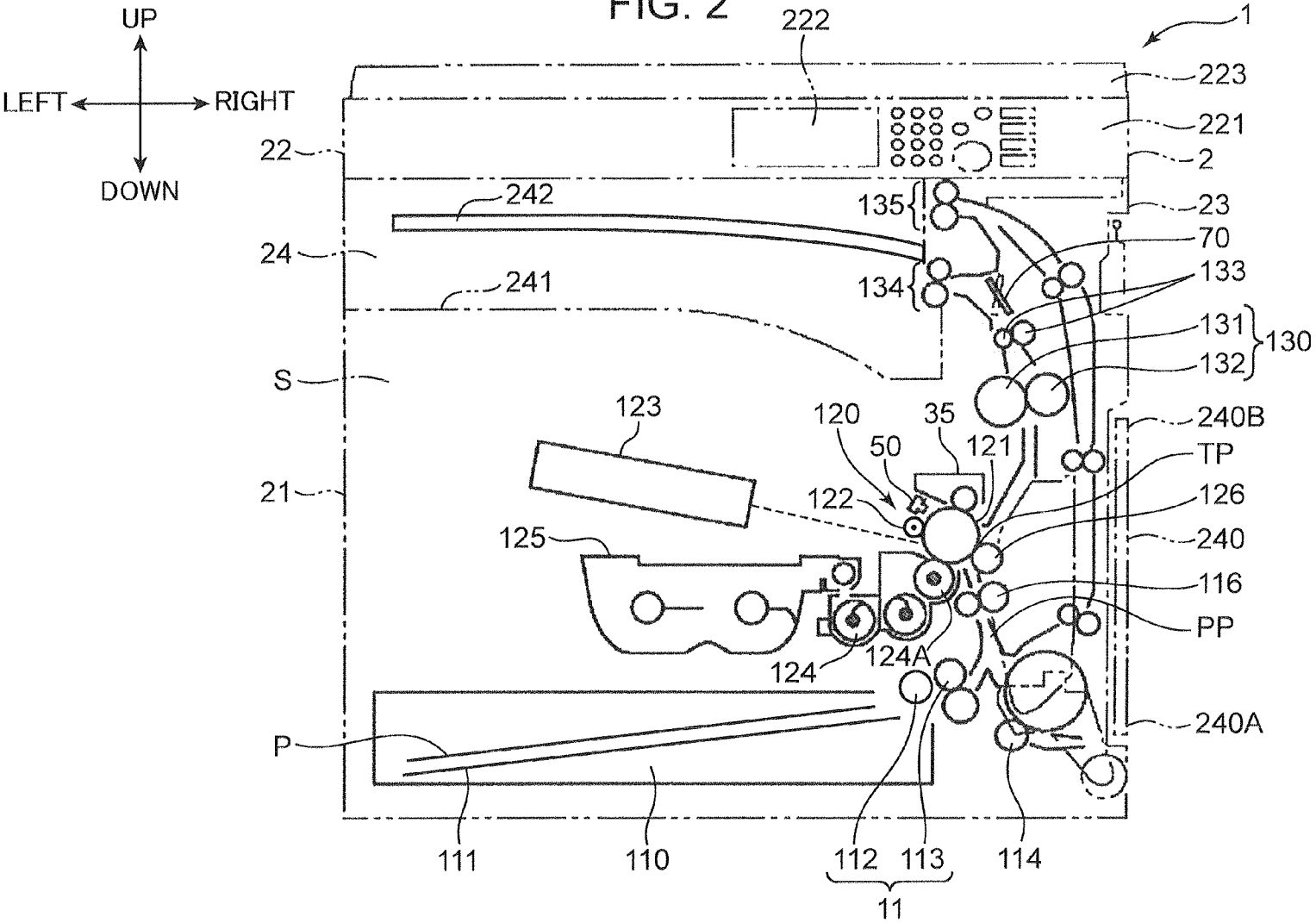
FIG. 2 is an internal cross-sectional view of the image forming apparatus.

In the following, an embodiment of the present disclosure is described in detail referring to the drawings. FIG. 1 is an external perspective view of an image forming apparatus 1 according to an embodiment of the present disclosure, and FIG. 2 is an internal cross-sectional view of the image forming apparatus 1. The image forming apparatus 1 shown in FIG. 1 and FIG. 2 is a so-called monochromatic multifunction device. In another embodiment, the image forming apparatus may be any other apparatus for forming a toner image on a sheet, such as a color multifunction device, a color printer, or a facsimile machine. The terms indicating the directions such as "down", "front", "rear", "left", and "right" used in the following description are provided simply for clarifying the description, and do not limit the principle of an image forming apparatus in every aspect. Further, in the following description, the term "sheet" means a copy sheet, coated paper, an OHP sheet, thick paper, a post card, tracing paper, or other sheet member subjected to an image forming process; or a sheet member subjected to a process other than the image forming process.

The image forming apparatus 1 includes a substantially rectangular parallelepiped-shaped main housing portion 2. The main housing portion 2 includes a substantially rectangular parallelepiped-shaped lower housing portion 21, a substantially rectangular parallelepiped-shaped upper housing portion 22 which is disposed above the lower housing portion 21, and a connection housing portion 23 for connecting between the lower housing portion 21 and the upper housing portion 22. The connection housing portion 23 extends along a right perimeter and a rear perimeter of the main housing portion 2. A sheet subjected to printing is discharged to a discharge space 24 surrounded by the lower housing portion 21, the upper housing portion 22, and the connection housing portion 23. In particular, in this embodiment, a sheet is discharged to a sheet discharge portion 241 formed on an upper surface of the lower housing portion 21, or a sheet discharge tray 242 (see FIG. 2) disposed above the sheet discharge portion 241.

An operation portion 221 which is disposed in a front of the upper housing portion 22 includes an LCD touch panel 222. The operation portion 221 is configured such that a user is allowed to input information relating to an image forming process. The user is allowed to input the number of sheets to be printed or a printing density through the LCD touch panel 222, for instance. A device for reading a document image, and an electronic circuit for controlling the overall operation of the image forming apparatus 1 are mainly housed in the upper housing portion 22.

A pressing cover 223 disposed above the upper housing portion 22 is used for pressing a document. The pressing cover 223 is mounted on the upper housing portion 22 to be pivotally movable up and down. The user is allowed to pivotally move the pressing cover 223 upward, and place a document on the upper housing portion 22. Thereafter, the user is allowed to operate the operation portion 221 for causing the device disposed in the upper housing portion 22 to read an image of the document.

A manual tray 240 (see FIG. 2) is mounted on a right surface of the lower housing portion 21. The manual tray 240 is configured such that an upper end 240B thereof is pivotally movable up and down about a lower end 240A as a pivot point. When the manual tray 240 is pivotally moved downward, and is set to such a position as to project rightwardly from the lower housing portion 21, the user is allowed to place a sheet or sheets on the manual tray 240. After a sheet on the manual tray 240 is fed into the lower housing portion 21, based on an instruction input by the user through the operation portion 221, the sheet is subjected to an image forming process, and discharged to the discharge space 24. Further, an inner space S in which various devices to be described later are disposed is formed in the lower housing portion 21 (see FIG. 2).

The image forming apparatus 1 is provided with, in the inner space S, a cassette 110, a sheet feeding portion 11, a second sheet feeding roller 114, a registration roller pair 116, and an image forming assembly 120. The sheet feeding portion 11 is provided with a pickup roller 112 and a first sheet feeding roller 113. The sheet feeding portion 11 feeds a sheet P to a sheet transport path PP. The sheet transport path PP is a transport path extending from the sheet feeding portion 11 and passing a transfer position TP disposed in the image forming assembly 120 via the registration roller pair 116.

The cassette 110 accommodates sheets P therein. The cassette 110 is detachable from the lower housing portion 21 in a front direction (in forward direction as indicated by the corresponding arrow in FIG. 1). The sheets P accommodated in the cassette 110 are successively fed upward in the lower housing portion 21. Thereafter, a sheet P is subjected to an image forming process in the lower housing portion 21, based on an instruction input by the user through the operation portion 221, and discharged to the discharge space 24. The cassette 110 is provided with a lift plate 111 for supporting sheets P. The lift plate 111 is inclined in such a direction that leading ends of the sheets P are pushed upward.

The pickup roller 112 is disposed above the leading ends of the sheets P pushed upward by the lift plate 111. When the pickup roller 112 rotates, the sheets P are dispensed one by one from the cassette 110.

The first sheet feeding roller 113 is disposed on the downstream side of the pickup roller 112 in the sheet transport direction. The first sheet feeding roller 113 feeds a sheet P further downstream in the sheet transport direction. The second sheet feeding roller 114 is disposed on the inner side of the lower end 240A of the manual tray 240. The second sheet feeding roller 114 transports a sheet or sheets P on the manual tray 240 into the lower housing portion 21. The user is allowed to selectively dispense the sheets P housed in the cassette 110 or the sheet or sheets P placed on the manual tray 240.

The registration roller pair 116 defines the position of a sheet in the sheet transport direction. By the above configuration, the position of an image to be formed on a sheet P is adjusted. The registration roller pair 116 forms a nip portion therebetween. The registration roller pair 116 transports a sheet P to the image forming assembly 120 in synchronism with the timing of transferring a toner image onto the sheet P in the image forming assembly 120. The registration roller pair 116 is further provided with a function of correcting skew of a sheet P.

The image forming assembly 120 is provided with a photosensitive drum 121, a charger 122, an exposure device 123, a developing device 124, a toner container 125, a transfer roller 126, a cleaning device 35, and a static eliminator 50. The photosensitive drum 121, the charger 122, and the cleaning device 35 are integrally disposed in a drum unit 31H to be described later.

The photosensitive drum 121 has the shape of a cylindrical body, and includes a rotating shaft and a circumferential surface to be driven and rotated around the axis of the rotating shaft. An electrostatic latent image is formed on the circumferential surface of the photosensitive drum 121, and a toner image corresponding to the electrostatic image is carried thereon.

Upon application of a predetermined voltage to the charger 122, the charger 122 generally uniformly charges the circumferential surface of the photosensitive drum 121. The exposure device 123 irradiates the circumferential surface of the photosensitive drum 121 charged by the charger 122, with laser light. The laser light is irradiated in accordance with image data output from an external device (not shown) such as a personal computer communicatively connected to the image forming apparatus 1. By the irradiation, an electrostatic latent image corresponding to the image data is formed on the circumferential surface of the photosensitive drum 121.

The developing device 124 supplies toner to the circumferential surface of the photosensitive drum 121 on which an electrostatic latent image is formed. The toner container 125 supplies toner to the developing device 124. The toner container 125 supplies toner to the developing device 124 successively or as required. When the developing device 124 supplies toner to the photosensitive drum 121, an electrostatic latent image formed on the circumferential surface of the photosensitive drum 121 is developed to a toner image. By the development, the toner image is formed on the circumferential surface of the photosensitive drum 121. The developing device 124 is provided with a developing roller 124A for carrying toner on the circumferential surface thereof. The developing roller 124A is disposed to face the photosensitive drum 121 at a developing position. The developing roller 124A is driven and rotated to supply toner to the photosensitive drum 121.

The transfer roller 126 is disposed to face the circumferential surface of the photosensitive drum 121 at the transfer position TP. The transfer roller 126 is driven and rotated in the same direction as the rotating direction of the photosensitive drum 121 at the transfer position TP. A toner image formed on the circumferential surface of the photosensitive drum 121 is transferred onto a sheet P at the transfer position TP.

After a toner image is transferred onto a sheet P, the cleaning device 35 removes the toner remaining on the circumferential surface of the photosensitive drum 121. The static eliminator 50 irradiates the circumferential surface of the photosensitive drum 121 which has undergone the cleaning process by the cleaning device 35, with predetermined static eliminating light. By the irradiation, the electric potential of the circumferential surface of the photosensitive drum 121 is made uniform.

The circumferential surface of the photosensitive drum 121, which has undergone the cleaning process by the cleaning device 35 and the static elimination process by the static eliminator 50, is uniformly charged by the charger 122 while passing below the charger 122. Thereafter, the aforementioned toner image forming operation is performed for a next image formation.

The image forming apparatus 1 is further provided with a fixing device 130, on the downstream side of the image forming assembly 120 in the sheet transport direction, for fixing a toner image on a sheet P. The fixing device 130 is provided with a heater roller 131 for fusing toner on a sheet P, and a pressure roller 132 for contacting the sheet P with the heater roller 131 in a pressurized state. When a sheet P passes between the heater roller 131 and the pressure roller 132, the toner image is fixed on the sheet P.

The image forming apparatus 1 is further provided with a transport roller pair 133 disposed downstream of the fixing device 130, a switching portion 70 disposed downstream of the transport roller pair 133, a lower discharge roller 134, and an upper discharge roller 135. The transport roller pair 133 transports a sheet P subjected to a fixing process by the fixing device 130 downstream in the sheet transport direction. The switching portion 70 has a function of switching the transport direction of a sheet P on the downstream side of the transport roller pair 133 in the sheet transport direction. The lower discharge roller 134 is disposed on the left side of the switching portion 70, and discharges a sheet P transported by the transport roller pair 133 to the sheet discharge portion 241. The upper discharge roller 135 is disposed above the lower discharge roller 134, and discharges a sheet P transported by the transport roller pair 133 to the sheet discharge tray 242 mounted above the sheet discharge portion 241.

Figure 3A:
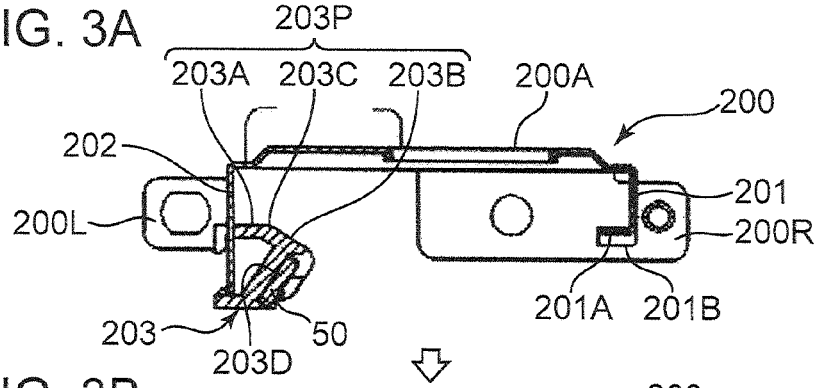
FIG. 3A is a cross-sectional view of a rail member (drum unit rail)
Figure 3B:
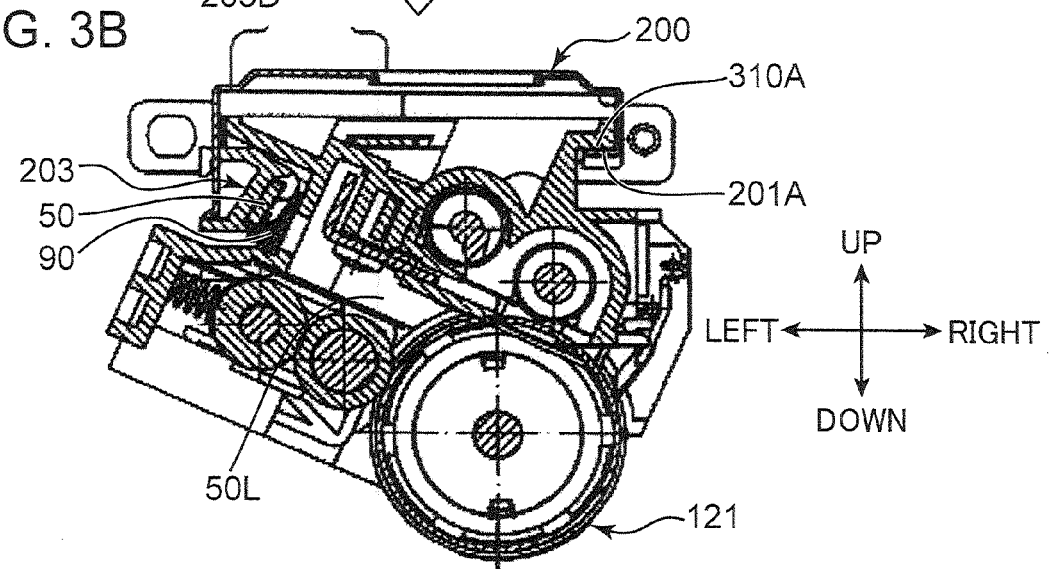
FIG. 3B is a cross-sectional view showing a state that a drum unit is mounted to the rail member.
Figure 3C:
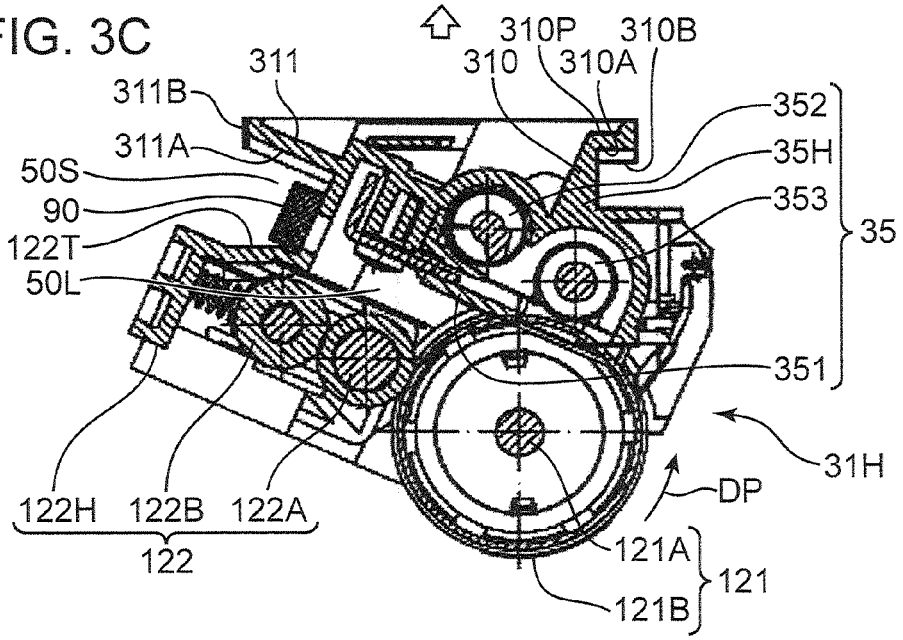
FIG. 3C is a cross-sectional view of the drum unit.
Figure 4:
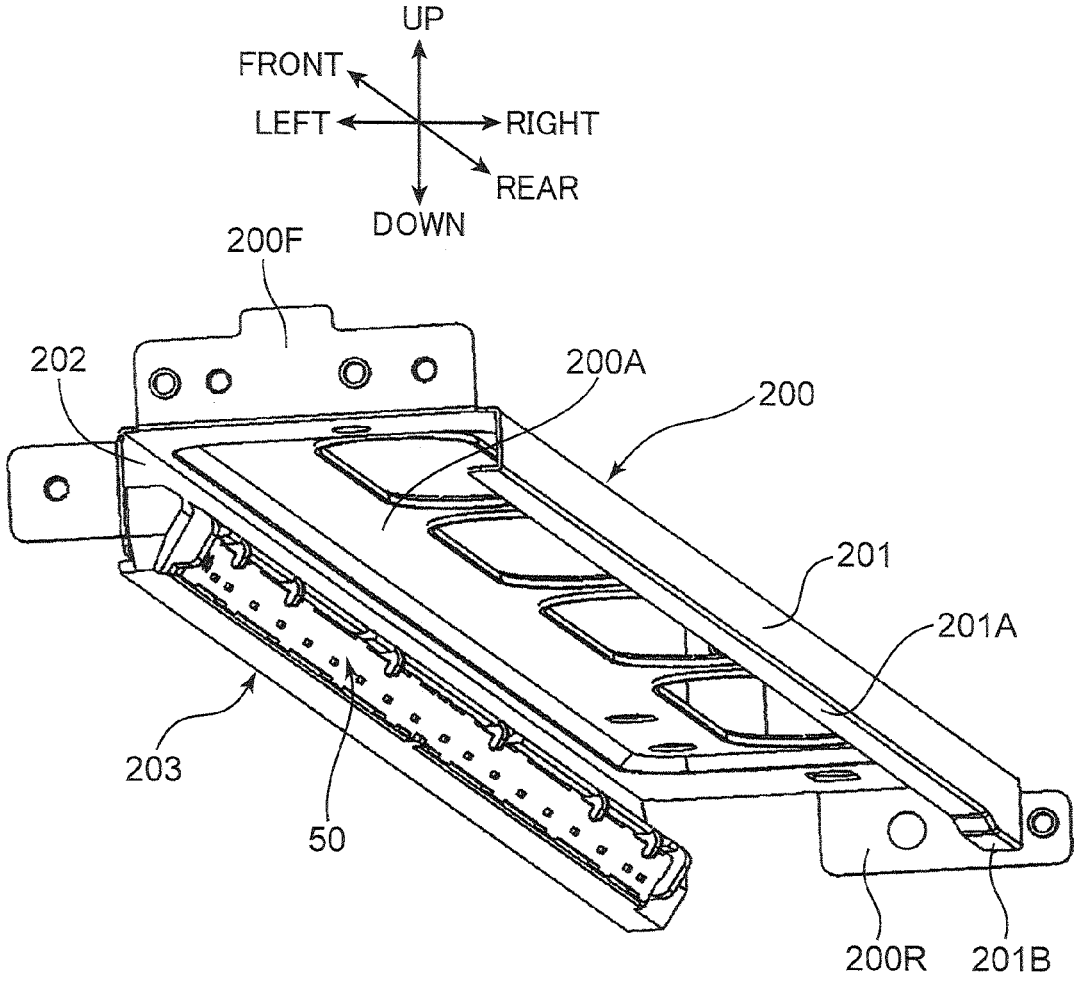
FIG. 4 is a perspective view of the rail member.
Figure 5:
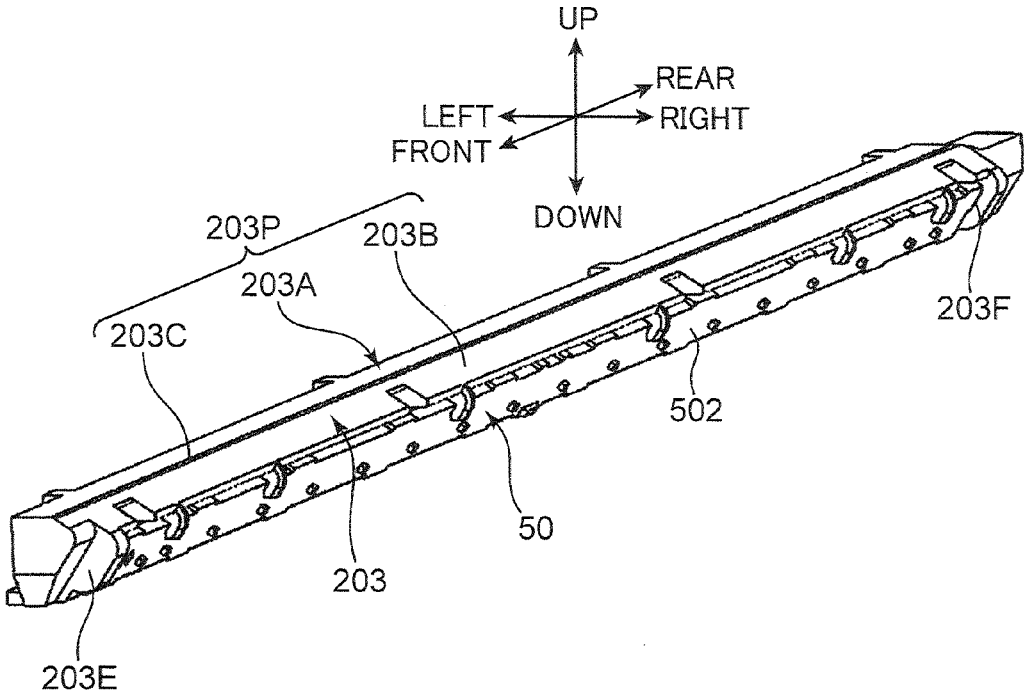
FIG. 5 is a perspective view of a static eliminator holder.
Figure 6:
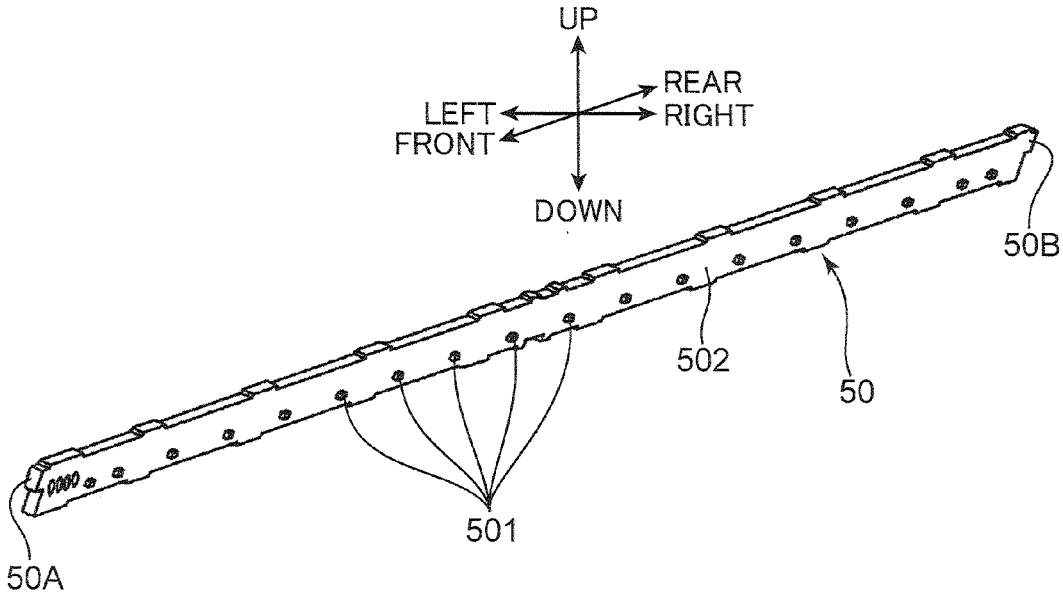
FIG. 6 is a perspective view of a static eliminator.
Figure 7:
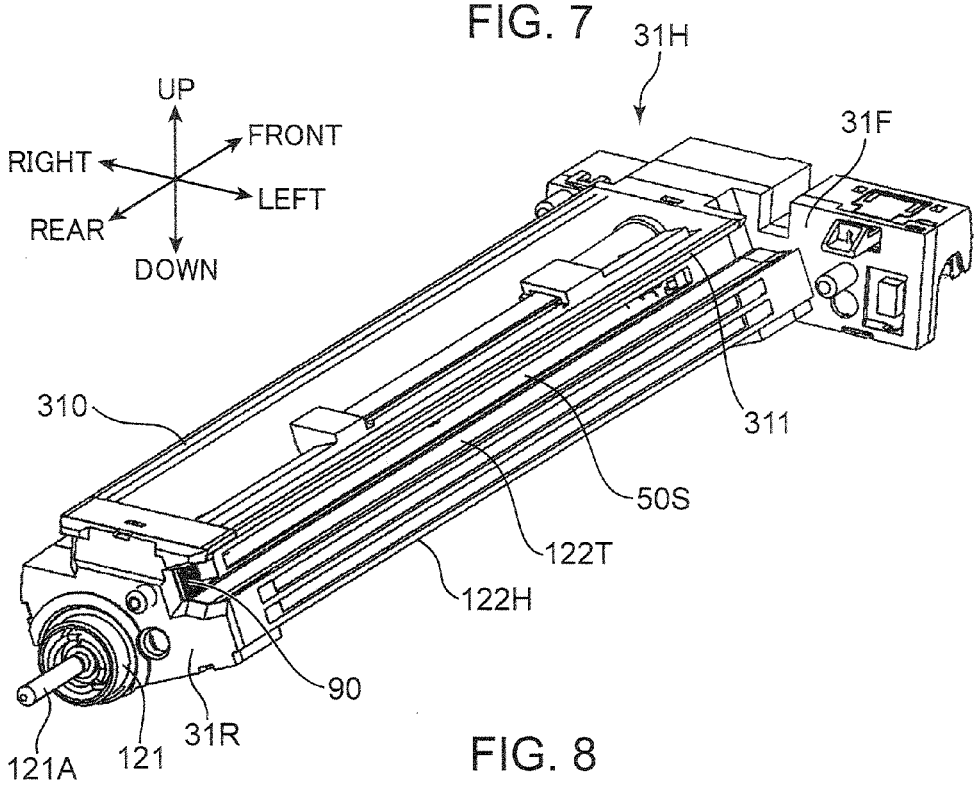
FIG. 7 is a perspective view of the drum unit.
Figure 8:
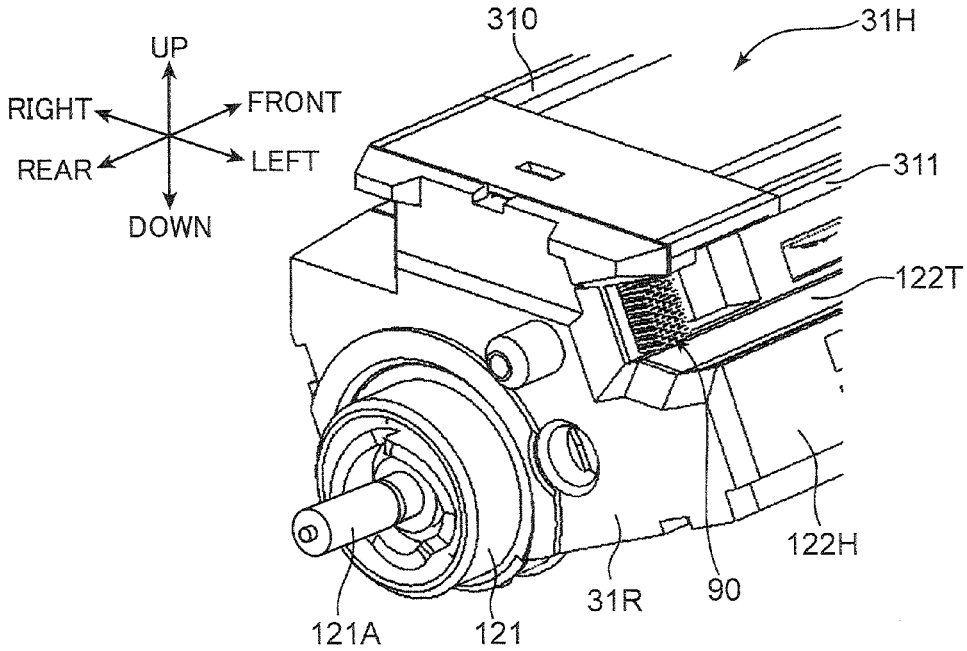
FIG. 8 is an enlarged perspective view of the drum unit.

In the following, a manner as to how the drum unit 31H is mounted in the inner space S of the lower housing portion 21 is described in addition to the structure of the drum unit 31H according to the embodiment, referring to FIGS. 3A through 8. FIGS. 3A through 3C are cross-sectional views showing a positional relationship between the drum unit 31H according to the embodiment, and a drum unit rail 200 (rail member) fixedly mounted in the inner space S of the lower housing portion 21. Specifically, FIG. 3A is a cross-sectional view of the drum unit rail 200, FIG. 3C is a cross-sectional view of the drum unit 31H, and FIG. 3B is a cross-sectional view showing a process of mounting the drum unit 31H to the drum unit rail 200. FIG. 4 is a perspective view of the drum unit rail 200. FIG. 5 is a perspective view of a static eliminator holder 203 fixedly mounted to the drum unit rail 200. FIG. 6 is a perspective view of the static eliminator 50 held on the static eliminator holder 203. FIG. 7 is a perspective view of the drum unit 31H. FIG. 8 is an enlarged perspective view of the drum unit 31H.

Referring to FIG. 3C, the drum unit 31H is provided with the photosensitive drum 121, the charger 122, and the cleaning device 35. The drum unit 31H is mounted in the inner space S in a state that the photosensitive drum 121, the charger 122, and the cleaning device 35 are integrally supported. The drum unit 31H is provided with, at both ends in front and rear directions thereof, a unit front wall 31F and a unit rear wall 31R. The unit front wall 31F and the unit rear wall 31R constitute a pair of side plates facing in front and rear directions. The photosensitive drum 121 is rotatably supported by the unit front wall 31F and the unit rear wall 31R. Further, the charger 122 and the cleaning device 35 are supported by the unit front wall 31F and the unit rear wall 31R so as to face the photosensitive drum 121.

Referring to FIG. 3C, the photosensitive drum 121 is driven and rotated in the arrow direction DP. The photosensitive drum 121 is provided with a rotating shaft 121A, and a cylindrical surface 121B (circumferential surface) which rotates around the axis of the rotating shaft 121A. An electrostatic latent image is formed on the cylindrical surface 121B, and a toner image corresponding to the electrostatic latent image is carried thereon. An example of the photosensitive drum 121 is a photosensitive drum using an amorphous silicon (a-Si)-based material.

The drum unit 31H is provided with fixing portions (not shown) formed in the unit front wall 31F and the unit rear wall 31R. When the drum unit 31H is mounted in the lower housing portion 21 of the image forming apparatus 1, the fixing portions are fixedly engaged with the lower housing portion 21 of the image forming apparatus 1. As a result, the position of the drum unit 31H is fixed in the image forming apparatus 1. The fixing portions are constituted of fastening holes in which screws are fastened, for instance.

The charger 122 is disposed on the left side with respect to the photosensitive drum 121. The charger 122 is provided with a charging roller 122A, a cleaning roller 122B, and a charging housing 122H. The charging housing 122H has a substantially U-shape in a sectional view perpendicular to the rotating shaft 121A of the photosensitive drum 121, and is opened toward the photosensitive drum 121. The upper side of the charging housing 122H is defined by a charger top wall 122T. In FIGS. 3B and 3C, a wall portion corresponding to the lower side of the charging housing 122H is not shown. The charging roller 122A and the cleaning roller 122B are respectively rotatably supported in the charging housing 122H. The charging housing 122H constitutes a part of the drum unit 31H.

The charging roller 122A is a roll member with a surface thereof made of a rubber material. A charging voltage is applied to the charging roller 122A by an unillustrated bias application means. The charging roller 122A is rotated together with the photosensitive drum 121 while keeping in contact with the cylindrical surface 121B of the photosensitive drum 121. The cylindrical surface 121B of the photosensitive drum 121 is uniformly charged by the charging roller 122A to which a charging voltage is applied.

The cleaning roller 122B rotates with a linear velocity difference with respect to the charging roller 122A while keeping in contact with the charging roller 122A. The cleaning roller 122B is a brush roller formed of conductive nylon fibers. When the charging roller 122A comes into contact with the cylindrical surface 121B of the photosensitive drum 121, toner, foreign matter, or the like adheres to the surface of the charging roller 122A. The cleaning roller 122B appropriately removes such toner, foreign matter, or the like adhered to the surface of the charging roller 122A by rotating with a linear velocity difference with respect to the charging roller 122A while keeping in contact with the charging roller 122A.

The cleaning device 35 is disposed above the photosensitive drum 121. The cleaning device 35 is provided with a cleaner housing 35H, a cleaning blade 351, a transport screw 352, and an abrasive roller 353.

The cleaner housing 35H is a housing which supports the respective members in the cleaning device 35. The cleaner housing 35H constitutes a part of the drum unit 31H. The cleaning device 35 is disposed in such a manner as to cover the photosensitive drum 121 and the charging roller 122A from above. In particular, the left portion of the cleaner housing 35H is disposed above the charging roller 122A. Further, the cleaner housing 35 has such a configuration that, in a sectional view perpendicular to the rotating shaft 121A of the photosensitive drum 121, a center portion of the cleaner housing 35H in left and right directions thereof surrounds the transport screw 352, and projects upward in an arc shape.

The cleaning blade 351 extends along a left-side bottom portion of the cleaner housing 35H with a certain angle with respect to a horizontal direction. The cleaning blade 351 is a plate like member constituted of a rubber material. The tip end of the cleaning blade 351 is a free end, and comes into contact with the cylindrical surface 121B of the photosensitive drum 121. The toner remaining on (adhering to) the cylindrical surface 121B of the photosensitive drum 121 is removed by the tip end of the cleaning blade 351.

The transport screw 352 is rotatably supported by the cleaner housing 35H at a position above the cleaning blade 351. The transport screw 352 is provided with a shaft portion, and a spiral blade member formed around the shaft portion. The transport screw 352 transports the recovered toner that has been scraped off by the cleaning blade 351 and deposited on the cleaning blade 351 in the axis direction of the rotating shaft 121A of the photosensitive drum 121.

The abrasive roller 353 is disposed at a position corresponding to a lower right portion of the transport screw 352. The abrasive roller 353 has a circumferential surface to be contacted with the cylindrical surface 121B of the photosensitive drum 121 at a position more above the rotating shaft 121A of the photosensitive drum 121. The abrasive roller 353 is a rubber roller with a circumferential surface thereof subjected to surface roughness treatment. The abrasive roller 353 is rotated together with the photosensitive drum 121 while keeping in contact with the cylindrical surface 121B of the photosensitive drum 121. The abrasive roller 353 recovers the toner adhered to the cylindrical surface 121B of the photosensitive drum 121. Further, the abrasive roller 353 abrasively removes the matter such as corona products adhered to the cylindrical surface 121B of the photosensitive drum 121. In performing the above operation, the removal performance (abrasive performance) of the corona products is enhanced by in a state that a certain amount of toner adheres on the circumferential surface of the abrasive roller 353.

Referring to FIG. 3C, FIG. 7, and FIG. 8, the drum unit 31H is further provided with a right insertion piece 310 and a left insertion piece 311. The right insertion piece 310 and the left insertion piece 311 are engaged with the drum unit rail 200 to be described later, when the drum unit 31H is mounted in the inner space S of the lower housing portion 21.

The right insertion piece 310 is a wall portion extending in front and rear directions at a position above the cleaner housing 35H (see FIG. 7 and FIG. 8). Referring to FIG. 3C, the right insertion piece 310 projects upward from the cleaner housing 35H in a sectional view perpendicular to the rotating shaft 121A of the photosensitive drum 121. Further, a tip end 310P (first guided portion) of the right insertion piece 310 is formed by bending a tip end portion of the right insertion piece 310 in a right direction. In other words, the tip end 310P of the right insertion piece 310 projects in a right direction (first direction). A right contact portion 310A is formed on a part of the tip end 310P facing downward in a vertical direction. The right contact portion 310A is contacted with a right support portion 201A of the drum unit rail 200 to be described later. Further, a right projecting portion 310B is formed consecutively from a rear portion of the right contact portion 310A. The right projecting portion 310B is formed by projecting a rear end of the right contact portion 310A slightly downward.

The left insertion piece 311 (second guided portion) is a wall portion extending in front and rear directions at a position above the cleaner housing 35H, as with the case of the right insertion piece 310 (see FIG. 7). Referring to FIG. 3C, the left insertion piece 311 extends in a left direction (second direction) on a left end of the cleaner housing 35H. Specifically, the left insertion piece 311 projects in a left direction with a slightly upward inclination. In other words, the left insertion piece 311 projects in a direction substantially opposite to the direction in which the tip end 310P of the right insertion piece 310 projects. A left contact portion 311A is formed on a lower surface portion of the left insertion piece 311. The left contact portion 311A is contacted with a contact surface 203P of the drum unit rail 200 to be described later. Further, a left upright wall 311B is formed consecutively from a left-side tip end of the left contact portion 311A. The left upright wall 311B is a wall portion standing upward in a vertical direction with a slight height in a direction perpendicular to the left contact portion 311A.

In this embodiment, the charger 122 is disposed below the left insertion piece 311. As will be described later, a housing space 50S for housing the static eliminator 50 is formed between the left insertion piece 311 and the charger 122.

The drum unit 31H is further provided with a cleaning brush 90. The cleaning brush 90 is disposed between the left insertion piece 311 and the charger 122 in a rear portion of the housing space 50S (see FIG. 7 and FIG. 8). The cleaning brush 90 is formed of a number of brushing bristles extending in a direction away from the photosensitive drum 121 on an outer wall portion of the unit rear wall 31R. The cleaning brush 90 is formed of the number of brushing bristles implanted in a substantially rectangular sheet like member.

In the following, the drum unit rail 200 (rail member) according to the embodiment is described referring to FIGS. 4 through 6. The drum unit rail 200 extends in the inner space S of the lower housing portion 21 along the axis direction of the rotating shaft 121A of the photosensitive drum 121. The drum unit rail 200 guides the drum unit 31H along the axis direction, when the drum unit 31H is mounted to the drum unit rail 200. The drum unit rail 200 has a substantially U-shape in a sectional view in up and down directions and in left and right directions (sectional view perpendicular to the rotating shaft 121A of the photosensitive drum 121), and is opened downward in a vertical direction. The drum unit rail 200 is formed by bending a sheet metal member.

The drum unit rail 200 is provided with an upper surface portion 200A, a front plate 200F, a rear plate 200R, a rear fixing portion 200L, a right rail portion 201 (first guide portion), a left rail portion 202, and the static eliminator holder 203 (second guide portion/substrate holder).

The upper surface portion 200A is a main body portion of the drum unit rail 200, and extends in front and rear directions with a certain width in left and right directions. The front plate 200F is a wall portion standing upward on a front end of the upper surface portion 200A. Plural hole portions are formed in the front plate 200F, and unillustrated screws passing through the respective hole portions are fastened to an unillustrated frame of the lower housing portion 21.

The rear plate 200R is a wall portion standing downward on a rear end of the upper surface portion 200A. As with the case of the front plate 200F, hole portions for passing through fixing screws are formed in the rear plate 200R. Further, the rear fixing portion 200L (see FIG. 3A) is mounted to a left portion of the rear end of the upper surface portion 200A to face the rear plate 200R. An opening is formed in a center portion of the rear fixing portion 200L. A positioning stud projecting from the unillustrated frame of the lower housing portion 21 is inserted in the opening.

The right rail portion 201 is a wall portion projecting downward on a right end of the upper surface portion 200A. The right rail portion 201 extends along front and rear directions. The right support portion 201A is formed consecutively from a lower end of the right rail portion 201. The right support portion 201A is a wall portion projecting in a left direction from the lower end of the right rail portion 201. The right support portion 201A is disposed to face the tip end 310P of the right insertion piece 310 of the drum unit 31H in up and down directions. Further, a right step portion 201B is formed at a rear end of the right support portion 201A. The right step portion 201B is formed by bending the rear end of the right support portion 201A downward with a step.

The left rail portion 202 is a wall portion projecting downward on a left end of the upper surface portion 200A. The left rail portion 202 extends along front and rear directions. Further, the left rail portion 202 is disposed to face the right rail portion 201.

The static eliminator holder 203 is fixedly mounted to a lower end of the left rail portion 202. The static eliminator holder 203 extends along front and rear directions, and faces the left insertion piece 311. Referring to FIG. 3A and FIG. 5, the static eliminator holder 203 (substrate holder) is provided with the contact surface 203P (contact surface), a static eliminator support surface 203D (support surface), a holder front wall 203E, and a holder rear wall 203F.

The contact surface 203P is a wall surface of the static eliminator holder 203 that faces upward. The contact surface 203P extends in a right direction from the left rail portion 202. The contact surface 203P is provided with a holder upper surface portion 203A, a holder slanting portion 203B, and a holder bent portion 203C. The holder upper surface portion 203A is a wall portion extending horizontally on an upper end of the static eliminator holder 203. The holder upper surface portion 203A is formed consecutively from the left rail portion 202. The holder slanting portion 203B is a wall portion formed consecutively from a right end of the holder upper surface portion 203A with a certain angle. The holder slanting portion 203B is an inclined surface inclined downward, as the holder slanting portion 203B is away from the left rail portion 202. The holder bent portion 203C is a ridge portion extending in front and rear directions between the holder upper surface portion 203A and the holder slanting portion 203B.

The static eliminator support surface 203D is a wall portion formed consecutively from the holder slanting portion 203B in a direction perpendicular to the holder slanting portion 203B. The static eliminator support surface 203D faces downward in a vertical direction. The drum unit 31H is disposed to face the cylindrical surface 121B of the photosensitive drum 121 in a state that the drum unit 31H is mounted in the inner space S of the lower housing portion 21 via the drum unit rail 200. Further, the holder front wall 203E and the holder rear wall 203F are wall portions each standing upright in a direction perpendicular to the static eliminator support surface 203D at ends of the static eliminator support surface 203D in front and rear directions (see FIG. 5).

The static eliminator holder 203 is provided with the aforementioned static eliminator 50 held on the static eliminator support surface 203D. The static eliminator 50 is provided with a plate like substrate 502 extending in front and rear directions (axis direction), and plural LEDs (light emitting diodes) arranged on the substrate 502 with a certain interval in front and rear directions. An electric circuit is arranged on the substrate 502 for driving the LEDs 501. The LEDs 501 emit static eliminating light by application of a predetermined drive current thereto. A surface of the substrate 502 opposite to the surface thereof where the LEDs 501 are arranged is fixedly mounted to the static eliminator support surface 203D of the static eliminator holder 203. By the mounting, the static eliminator 50 carrying the LEDs 501 is held on the static eliminator holder 203. The LEDs 501 in the static eliminator 50 are disposed to face the cylindrical surface 121B of the photosensitive drum 121 in a state that the drum unit 31H is mounted in the inner space S of the lower housing portion 21 via the drum unit rail 200. In the above configuration, the LEDs 501 in the static eliminator 50 are disposed at positions closer to the cylindrical surface 121B of the photosensitive drum 121 than the contact surface 203P of the static eliminator holder 203.

Figure 9:
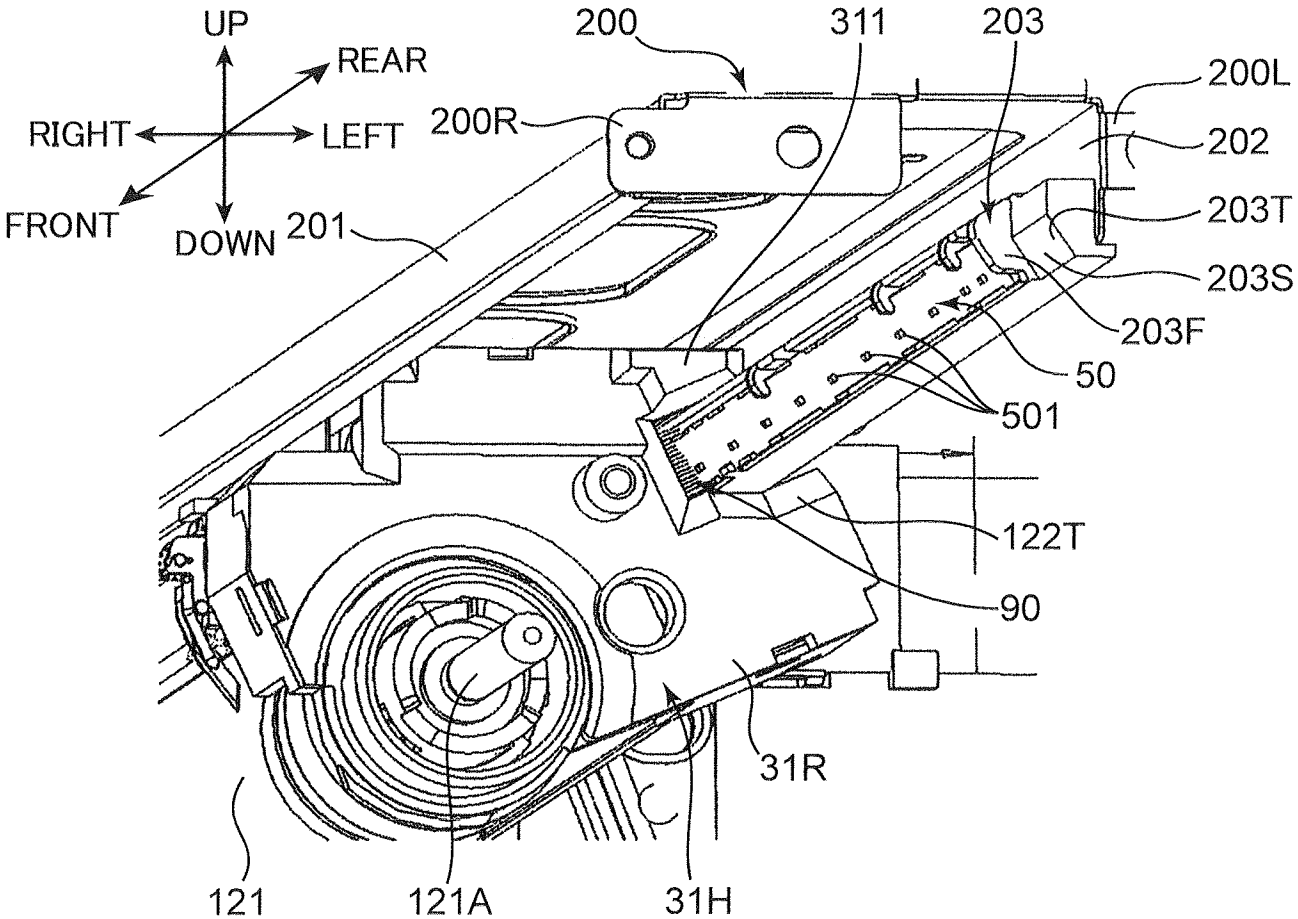
FIGS. 9 and 10 are perspective views showing a manner as to how the drum unit is mounted to the rail member.
Figure 10:
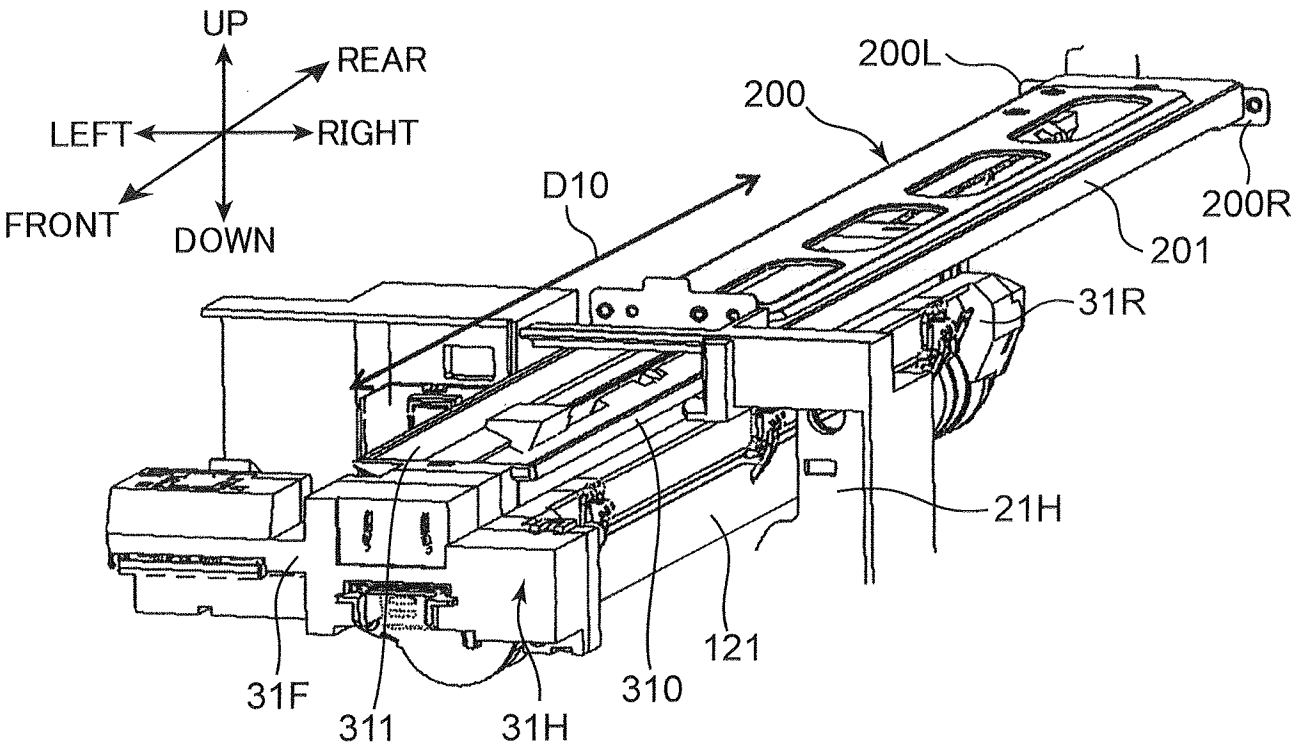

In the following, a manner as to how the drum unit 31 is mounted in the inner space S of the lower housing portion 21 is described in detail referring to FIGS. 3A through 3C, FIG. 9, and FIG. 10. FIG. 9 and FIG. 10 are perspective views showing a state that the drum unit 31H is mounted in the inner space S via the drum unit rail 200. FIG. 9 is a perspective view when viewed from rear side and from below, and FIG. 10 is a perspective view when viewed from front side and from above.

The user holds an unillustrated handle portion disposed at the unit front wall 31F of the drum unit 31H, and inserts the drum unit 31H into the inner space S toward the rear side (insertion direction of the drum unit 31H) of the lower housing portion 21. At the time of the insertion, the right insertion piece 310 of the drum unit 31H is engaged with the right rail portion 201 of the drum unit rail 200. Specifically, the right contact portion 310A of the right insertion piece 310 of the drum unit 31H is contacted with the right support portion 201A of the right rail portion 201 of the drum unit rail 200. Likewise, the left insertion piece 311 of the drum unit 31H is engaged with the static eliminator holder 203 of the drum unit rail 200. Specifically, the left contact portion 311A of the left insertion piece 311 of the drum unit 31H is contacted with the contact surface 203P of the static eliminator holder 203. The left contact portion 311A of the left insertion piece 311 is mainly contacted with the holder bent portion 203C of the contact surface 203P. By the contact, the static eliminator 50 held on the static eliminator holder 203 is disposed in the housing space 50S to be formed between the left insertion piece 311 and the charger top wall 122T of the charger 122 in the drum unit 31H.

The tip end 310P of the right insertion piece 310 of the drum unit 31H and the left insertion piece 311 of the drum unit 31H are inserted toward the rear side (in a rear portion) of the lower housing portion 21, while coming into contact with the right rail portion 201 of the drum unit rail 200 and the static eliminator holder 203 by the weight of the drum unit 31H. At the time of the insertion, the cleaning brush 90 (see FIG. 7 and FIG. 8) disposed on the unit rear wall 31R of the drum unit 31H comes into sliding contact with the surfaces of the LEDs 501 in the static eliminator 50 (see FIG. 3 and FIG. 9). Specifically, the cleaning brush 90 cleans the LEDs 501 in the static eliminator 50, as the drum unit 31H is mounted in the inner space S of the lower housing portion 21.

When the drum unit 31H is inserted in the rear portion of the inner space S, the right projecting portion 310B (see FIG. 3C) of the drum unit 31H is engaged with the right step portion 201B (see FIG. 4) of the drum unit rail 200. As a result, mounting of the drum unit 31 to the inner space S is completed. In this example, the cleaning brush 90 is disposed in a brush retracting space 203S formed on the rear side (downstream side in the insertion direction) of the holder rear wall 203F of the static eliminator holder 203. In this configuration, there is no likelihood that the cleaning brush 90 may face the LEDs 501 in the static eliminator 50 in a sectional view in up and down directions and in left and right directions. This prevents the cleaning brush 90 from blocking static eliminating light to be irradiated from the LEDs 501. An opposing surface 203T disposed in parallel to the static eliminator support surface 203D (see FIG. 3A), among the walls defining the brush retracting space 203S, is disposed at a position farther from the photosensitive drum 121 than the surface of the substrate 502 where the LEDs 501 are mounted. In other words, a space is formed between the tip ends of the brushing bristles of the cleaning brush 90 disposed in the brush retracting space 203S, and the opposing surface 203T. This suppresses contact of the tip ends of the bristles of the cleaning brush 90 with the opposing surface 203T for a long period of time in the brush retracting space 203S, thereby preventing falling down of the bristles.

Referring to FIG. 3B, an optical path 50L of static eliminating light from the static eliminator 50 is formed between the charger 122 of the drum unit 31H, and the cleaning device 35 in a state that mounting of the drum unit 31H in the inner space S is completed. More specifically, the optical path 50L is formed between a lower surface of the cleaning device 35 along which the cleaning blade 351 extends, and the charger top wall 122T of the charger 122.

As described above, according to the embodiment, the photosensitive drum 121 is provided with the rotating shaft 121A, and the cylindrical surface 121B to be driven and rotated around the axis of the rotating shaft 121A for carrying an image on the cylindrical surface 121B. The drum unit 31H is mounted in the inner space S of the lower housing portion 21, after the drum unit 31H is inserted in the inner space S of the lower housing portion 21 along the axis direction of the rotating shaft 121A in a state that the photosensitive drum 121 is integrally supported. The drum unit rail 200 extends along the axis direction in the inner space S, and guides the drum unit 31H in the axis direction when the drum unit 31H is mounted. The static eliminator 50 for irradiating the cylindrical surface 121B of the photosensitive drum 121 with static eliminating light is fixedly mounted to the drum unit rail 200.

The above configuration is advantageous in reducing the cost of the drum unit 31H, as compared with a configuration, in which the static eliminator 50 is disposed in the drum unit 31H. Further, the static eliminator 50 is fixedly mounted to the drum unit rail 200 for guiding the drum unit 31H. This is advantageous in disposing the static eliminator 50 in proximity to the photosensitive drum 121, and in appropriately maintaining the position precision between the static eliminator 50 and the photosensitive drum 121. Further, since the static eliminator 50 is not fixed to the drum unit 31H, this is advantageous in suppressing the heat generated in the static eliminator 50 from stagnating in the drum unit 31H.

Further, the drum unit 31H is provided with the tip end 310P of the right insertion piece 310 projecting in a right direction (first direction), and the left insertion piece 311 projecting in a left direction (second direction) in a sectional view perpendicular to the axis direction of the photosensitive drum 121. The drum unit rail 200 is provided with the right rail portion 201 disposed to face the right insertion piece 310, and the static eliminator holder 203 disposed to face the left insertion piece 311. The drum unit 31H is mounted in the inner space S, with the engagement between the right insertion piece 310 and the right rail potion 201, and between the left insertion piece 311 and the static eliminator holder 203. At the time of the mounting, the static eliminator 50 is held on the static eliminator holder 203 of the drum unit rail 200. Accordingly, the static eliminator 50 is disposed in a portion where the drum unit 31H engages with the drum unit rail 200, whereby the position precision between the static eliminator 50, and the photosensitive drum 121 in the drum unit 31H is appropriately maintained.

Furthermore, according to the embodiment, the tip end 310P of the right insertion piece 310 and the left insertion piece 311 come into contact with the right rail portion 201 and the static eliminator holder 203 by the weight of the drum unit 31H. Accordingly, the drum unit 31H is stably held on the drum unit rail 200 by the weight of the drum unit 31H.

The drum unit 31H is provided with the charger 122, disposed below the left insertion piece 311, for charging the cylindrical surface 121B of the photosensitive drum 121. The static eliminator 50 is held on the static eliminator holder 203, and is disposed between the left insertion piece 311 of the drum unit 31H and the charger 122. Accordingly, the static eliminator 50 is disposed to face the photosensitive drum 121, utilizing a region between the left insertion piece 311 of the drum unit 31H and the charger 122.

The static eliminator 50 is disposed at a position closer to the cylindrical surface 121B of the photosensitive drum 121 than the portion of the static eliminator holder 203 to be contacted with the left insertion piece 311. Accordingly, the static eliminator 50 is disposed at a position closer to the cylindrical surface 121B of the photosensitive drum 121. This is advantageous in appropriately maintaining the position precision between the static eliminator 50 and the cylindrical surface 121B of the photosensitive drum 121. Further, this is advantageous in stably irradiating the cylindrical surface 121B of the photosensitive drum 121 with static eliminating light to be irradiated from the static eliminator 50.

The static eliminator 50 is cleaned by the cleaning brush 90, each time the drum unit 31H is mounted in the inner space S of the lower housing portion 21. In this configuration, even in the case where dust and the like flow into the inner space S of the lower housing portion 21, and adhere to the static eliminator 50, as the drum unit 31H is dismounted or mounted, the dust and the like are removed by the cleaning brush 90. Accordingly, the cylindrical surface 121B of the photosensitive drum 121 is stably irradiated with static eliminating light from the static eliminator 50, after the drum unit 31H is mounted.

The cleaning brush 90 is disposed at a downstream end of the drum unit 31H in a direction along which the drum unit 31H is inserted in the inner space S. Further, the cleaning brush 90 is disposed on the downstream side of the static eliminator 50 in the insertion direction in a state that the drum unit 31H is mounted in the inner space S. This allows the cleaning brush 90 to clean the static eliminator 50 along the axis direction, when the drum unit 31H is inserted in the inner space S. Further, as the drum unit 31H is mounted in the inner space S, there is no likelihood that the cleaning brush 90 may block incidence of static eliminating light from the static eliminator 50, because the cleaning brush 90 is disposed on the downstream side of the static eliminator 50 in the insertion direction.

The static eliminator 50 is provided with the plural LEDs 501 arranged at a certain interval in the axis direction of the photosensitive drum 121, and the substrate 502 for supporting the LEDs 501. The static eliminator holder 203 supports the substrate 502 of the static eliminator 50. This provides the static eliminator holder 203 with the function of supporting the substrate 502 of the static eliminator 50, and the function of guiding the drum unit 31H in the axis direction.

The static eliminator holder 203 is provided with the contact surface 203P facing upward in a vertical direction in a sectional view perpendicular to the axis direction of the photosensitive drum 121 for contacting with the left insertion piece 311. The static eliminator holder 203 is further provided with the static eliminator support surface 203D facing downward in a vertical direction for supporting the substrate 502 of the static eliminator 50. Specifically, the contact surface 203P for sliding contact with the left insertion piece 311 of the drum unit 31H faces upward, and the static eliminator support surface 203D for supporting the substrate 502 of the static eliminator 50 faces downward. Accordingly, a load of the weight of the drum unit 31H is less likely to be applied to the substrate 502 of the static eliminator 50 supported on the static eliminator support surface 203D, when the contact surface 203P guides the drum unit 31H in the axis direction.

In the foregoing, an image forming apparatus according to an embodiment of the present disclosure has been described. The present disclosure is not limited to the above. For instance, the following modifications may be applied.

(1) In the embodiment, the static eliminator 50 is constituted of the LEDs 501 and the substrate 502. The present disclosure is not limited to the above. The static eliminator 50 may be constituted of another light emitting means.

(2) In the embodiment, the tip end 310P of the left insertion piece 310 and the left insertion piece 311 respectively project in a right direction and in a left direction. The present disclosure is not limited to the above. The respective guided portions of the drum unit 31H may be formed to project in directions other than the above.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus, comprising:

a housing provided with an inner space;

a photosensitive drum provided with a rotating shaft, and a circumferential surface to be driven and rotated around an axis of the rotating shaft for carrying an image on the circumferential surface;

a drum unit that is inserted in the inner space of the housing along the axis direction of the rotating shaft in a state that the photosensitive drum is integrally supported to be mounted in the inner space;

a rail member extending along the axis direction in the inner space for guiding the drum unit in the axis direction when the drum unit is mounted; and a static eliminator fixedly mounted to the rail member, and disposed to face the photosensitive drum in the drum unit mounted in the inner space for irradiating the circumferential surface of the photosensitive drum with static eliminating light, wherein in a sectional view perpendicular to the axis direction, the drum unit is provided with a first guided portion projecting in a first direction, and a second guided portion projecting in a second direction substantially opposite to the first direction, the rail member is provided with a first guide portion disposed to face the first guided portion, and a second guide portion disposed to face the second guided portion, the static eliminator is fixedly mounted to the first guide portion or the second guide portion, and the drum unit is inserted in the inner space, with engagement between the first guided portion and the first guide portion, and between the second guided portion and the second guide portion.

2. The image forming apparatus according to claim 1, wherein in the sectional view, the first guide portion extends in the second direction at a position below the first guided portion, and the second guide portion extends in the first direction at a position below the second guided portion, and the first guided portion and the second guided portion come into contact with the first guide portion and the second guide portion by the weight of the drum unit.

3. The image forming apparatus according to claim 1, further comprising:

a charger that charges the circumferential surface of the photosensitive drum, wherein the drum unit is disposed below the second guided portion in the sectional view, and the static eliminator is fixedly mounted to the second guide portion, and is disposed between the second guided portion of the drum unit and the charger.

4. The image forming apparatus according to claim 3, wherein the static eliminator is fixedly mounted to the second guide portion at a position closer to the circumferential surface of the photosensitive drum than a portion of the static eliminator to be contacted with the second guided portion.

5. An image forming apparatus, comprising:

a housing provided with an inner space;

a photosensitive drum provided with a rotating shaft, and a circumferential surface to be driven and rotated around an axis of the rotating shaft for carrying an image on the circumferential surface;

a drum unit that is inserted in the inner space of the housing along an axis direction of the rotating shaft in a state that the photosensitive drum is integrally supported to be mounted in the inner space;

a rail member extending along the axis direction in the inner space for guiding the drum unit in the axis direction when the drum unit is mounted; and a static eliminator fixedly mounted to the rail member, and disposed to face the photosensitive drum in the drum unit mounted in the inner space for irradiating the circumferential surface of the photosensitive drum with static eliminating light, wherein in a sectional view perpendicular to the axis direction, a cleaning member disposed in the drum unit to face the static eliminator fixedly mounted to the rail member, the cleaning member being brought into contact with the static eliminator for cleaning the static eliminator, as the drum unit is inserted in the inner space.

6. The image forming apparatus according to claim 5, wherein the cleaning member is disposed at a downstream end of the drum unit in a direction along which the drum unit is inserted in the inner space, and is disposed on a downstream side of the static eliminator in the insertion direction in a state that the drum unit is mounted in the inner space.

7. The image forming apparatus according to claim 2, wherein the static eliminator is provided with:

a plurality of light emitting diodes arranged in the axis direction at a certain interval; and a substrate extending in the axis direction for supporting the light emitting diodes, and the second guide portion is a substrate holder which holds the substrate.

8. The image forming apparatus according to claim 7, wherein the substrate holder is provided with:

a contact surface facing upward in a vertical direction in the sectional view perpendicular to the axis direction for contacting with the second guided portion; and a support surface facing downward in the vertical direction for supporting the substrate.

* * * * *